US006163264A

United States Patent [19]

Birch et al.

[11] Patent Number: 6,163,264

[45] Date of Patent: Dec. 19, 2000

[54] ELECTRICAL CONNECTORS, LAMPS AND LAMPHOLDERS

[76] Inventors: Andrew Clifford Birch, 5 Main Street, Hockwold-Cum-Wilton, Thetford, Norfolk IP26 4LB; Andrew John Warrington, Plot 4, School Road, Terrington St John, Wisbech, Cambridgeshire PE14 7SG; Trevor David Wolfe, 65 Ryston Road, Denver, Downham Market, Norfolk PE38 0DP, all of United Kingdom

[21] Appl. No.: 09/034,359

[22] Filed: Mar. 4, 1998

[30] Foreign Application Priority Data

Mar. 5, 1997 [GB] United Kingdom ..... 9704495

[51] Int. Cl.[7] ..... G08B 21/00

[52] U.S. Cl. ..... 340/641; 340/642; 340/635; 340/656; 439/490

[58] Field of Search ..... 340/641, 635, 340/656, 642; 439/490, 489, 488

[56] References Cited

U.S. PATENT DOCUMENTS

| | | | |
|---|---|---|---|
| 1,367,891 | 2/1921 | Richie . | |
| 2,503,677 | 4/1950 | McHenry et al. . | |
| 2,851,551 | 9/1958 | Lambert . | |
| 4,671,597 | 6/1987 | Grill . | |
| 5,207,594 | 5/1993 | Olson . | |
| 5,380,214 | 1/1995 | Ortega, Jr. | 439/253 |

FOREIGN PATENT DOCUMENTS

| | | |
|---|---|---|
| 16 36 661 | 4/1952 | Germany . |
| 74 03 889 | 6/1974 | Germany . |
| 512 774 | 12/1937 | United Kingdom . |
| 595 848 | 12/1947 | United Kingdom . |
| 701 292 | 12/1953 | United Kingdom . |
| 2 084 812 | 4/1982 | United Kingdom . |
| 2 214 007 | 8/1989 | United Kingdom . |
| WO 91/17591 | 11/1991 | WIPO . |

*Primary Examiner*—Julie Lieu
*Attorney, Agent, or Firm*—Young & Thompson

[57] ABSTRACT

A lamp has a tungsten filament within an evacuated glass bulb and connected to electrical conductors. Connected between the two electrical conductors are a series-connected neon and resistor. In use, the tungsten filament provides a primary light-emitting device, and the neon provides a secondary light-emitting device. The light intensity emitted by the filament is very much greater than that emitted by the neon. Therefore, in normal use, the neon will hardly be seen. However, in the event that the filament fails, the neon continues to emit light. With the main filament extinguished, the light emitted by the neon becomes quite visible, and serves to indicate the presence of electric power at the lamp contacts. Therefore, a user can switch off the power supply to the lamp at the local switch, the neon indicating when this has safely been done. Such a neon can alternatively be built into a lampholder, or into an electric power connector to indicate the presence of electric power at load contacts only when there is no load present at the load contacts or only when the load fails.

9 Claims, 3 Drawing Sheets

ELECTRICAL CONNECTORS, LAMPS AND LAMPHOLDERS

This invention relates to electrical connectors, lamps and lampholders.

When changing a failed lamp in a lampholder, it is not generally possible for a user to know whether power is present at the lamp contacts. Usually, the lamp itself gives such an indication but, of course, when it has failed, it no longer does so. The user should, in theory, isolate the electricity supply from the lampholder before changing the lamp. However, to be sure of this, the user usually has to revert to a main power supply unit in order to isolate the electricity supply altogether from the respective lampholder. Such a main power supply unit is usually located inconveniently, and isolates other circuits as well. This can be particularly inconvenient and cause other dangers, especially at night time, when it is dark. In reality, therefore, users rarely isolate an electricity supply as they ought to, in order to replace a failed lamp.

There is thus a small risk of electrocution of the user, by accidentally touching live lamp contacts whilst replacing a failed lamp. There is a greater risk of the non-professional user being startled and/or burning their fingers when the replacement lamp comes on unexpectedly while being inserted. If, as is often the case, the user is standing on a chair or ladder at the time, the risks of an accident are self-evident.

To check whether power is present at lamp contacts, it is generally of little use to refer to the position of a switch associated with a lampholder. Many switches have only one apparent position anyway (eg touch switches, push-push or pull-pull switches), and many switches are two-way or more and therefore have no definitive positions. Switches with mechanical indicators (eg with portions of different colours) can all to readily be fitted incorrectly.

It is known to provide switched electrical lampholders with internal illumination means such that the switch can be located in the dark. See, for example, WO 91/17591. However, the internal illumination means in such devices provides an indication only of power availability at the switch itself and gives no indication of the state of the switch—ie, whether or not there is power at the lamp contacts.

Preferred embodiments of the present invention aim to provide lamps or lampholders having means to indicate the presence of power at the lamp contacts when the lamp has failed.

In the context of this specification, the term "lamp contacts" means those contacts of a lampholder that make electrical contact with contacts on a lamp in order to supply electricity thereto and, equally, as the context requires, those contacts of a lamp that make electrical contact with such contacts on a lampholder.

Other embodiments of the present invention aim to provide electrical connectors having means to indicate the presence of power at load contacts when the load has failed, in a manner that provides extended life of such indicating means.

According to one aspect of the present invention, there is provided a lamp or lampholder having lamp contacts for supply electric power to a lamp in use, and an indicating means which is arranged to indicate the presence of electric power at said lamp contacts when the lamp fails.

Said indicating means may be arranged to indicate continuously the presence of electric power at said lamp contacts.

Said indicating means may be arranged to indicate the presence of electric power at said lamp contacts only when the lamp fails or, in the case of a lampholder, when no lamp is present.

Preferably, said indicating means is arranged to provide a visible indication.

Preferably, said indicating means includes a neon or light-emitting diode to give said visible indication.

Said indicating means may be arranged to provide an audible indication.

Said indicating means may be arranged to provide a vibratory indication.

A lampholder as above may be arranged as an adaptor to engage with an existing lampholder and to receive a lamp.

A lampholder as above may include a switch to connect and disconnect electric power to and from the lamp contacts.

A lamp as above may comprise a main light-emitting device and a secondary light-emitting device, wherein said main light-emitting device is adapted to provide the principal light output of the lamp and said secondary light-emitting device is adapted to serve as said indicating means.

Preferably, said main light-emitting device comprises a filament.

Preferably, the light output of said secondary light-emitting device is at least one order of magnitude less than that of said main light-emitting device.

Preferably, the light output of said secondary light-emitting device is at least two orders of magnitude less than that of said main light-emitting device.

Preferably, said main and secondary light-emitting devices are contained within the same evacuated enclosure.

According to another aspect of the present invention, there is provided an electric power connector having load contacts for supplying electric power to a load in use, and an indicating means which is arranged to indicate the presence of electric power at said load contacts only when there is no load present at the load contacts or only when the load fails.

Preferably, said indicating means is arranged to provide a visible indication.

Said indicating means may include a neon or light-emitting diode to give said visible indication.

Said indicating means may be arranged to provide an audible indication.

Said indicating means may be arranged to provide a vibratory indication.

An electric power connector as above may be arranged as an adaptor to engage with an existing electric power connector and to provide a connection equivalent to that provided by the existing electric power connector.

An electric power connector as above may include a switch to connect and disconnect electric power to and from said load contacts.

For a better understanding of the invention, and to show how embodiments of the same may be carried into effect, reference will now be made, by way of example, to the accompanying diagrammatic drawings, in which.

In the figures, like reference numerals denote like or corresponding parts.

Figure 1:
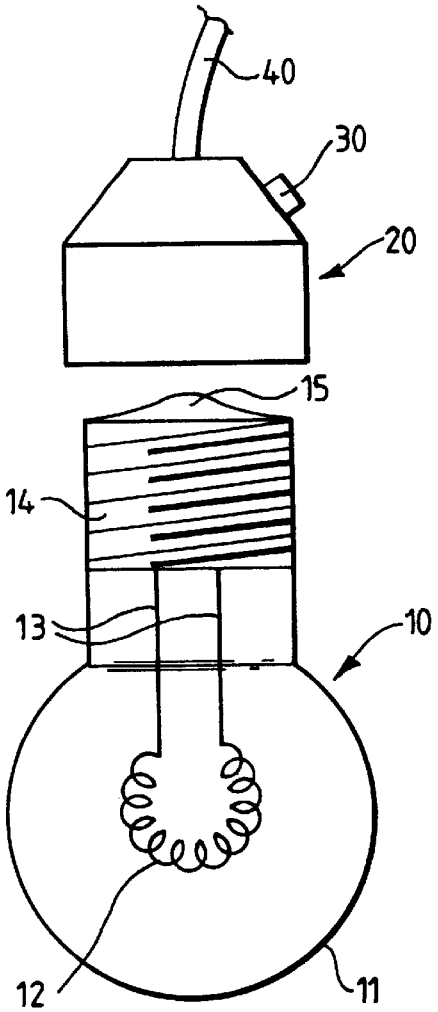
FIG. 1 shows one example of a lamp and lampholder in accordance with one embodiment of the invention, in side view.

FIG. 1 shows a conventional lamp 10 which engages with a novel lampholder 20. The lamp 10 comprises an evacuated glass bulb 11 in which there is disposed a tungsten filament 12 mounted on electrical conductors 13. One of the conductors 13 is in electrical contact with a metal cap 14 formed with in external screwthread. The other of the conductors 13 is an electrical contact with a central contact 15 which is arranged on the central axis of the lamp 10. In this way, the cap 14 and contact 15 provide lamp contacts of a conventional screw-type lamp. The invention may be applied to other types of lamp with other fittings—e.g. those with bayonet cap fittings, fluorescent lamps, etc.

The lampholder 20 is a suspension-type lampholder that is adapted to be suspended typically from a ceiling, and has a screw-type fitting adapted to receive and make electrical contact with the screw cap 14 and central contact 15 of the lamp 10 in a conventional manner. An electric power cord 40 supplies electric power to the lampholder 20. A novel feature of the lampholder 20 is that, provided on the exterior of its housing, at any convenient location, is an indicator device (e.g. incorporating a light-emitting diode (LED)) 30, that indicates the presence of electric power at lamp contacts of the lampholder 20.

Figure 2:
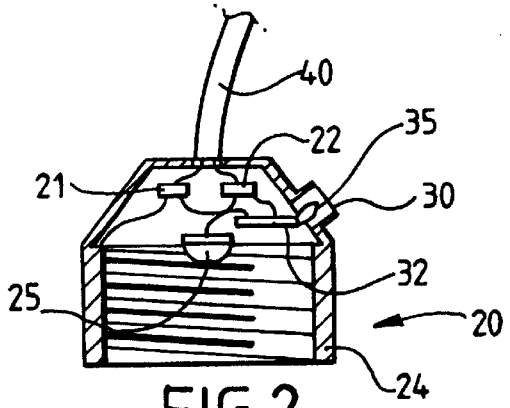
FIG. 2 shows the lampholder of FIG. 1, in section.

The lampholder 20 is shown in more detail in the sectional view of FIG. 2. A lamp contact 24 formed with an internal screwthread is adapted to receive and engage with the external screwthread of the lamp contact 14 on the lamp 10, and establish an electrical connection therewith. A central lamp contact 25 is arranged to engage with and establish electrical contact with the lamp contact 15 on the lamp 10, when the lamp 10 is fully screwed into the lampholder 20. The lamp terminals 24 and 25 are connected by respective electrical conductors to supply terminals 21 and 22, to which respective main supply conductors of the power cord 40 are also connected. An LED 35 is mounted on a circuit board 32, which is also connected to the supply terminals 21 and 22 by respective electrical conductors. The LED 35 projects into a lens or other housing, to provide the indicator 30. Although the indicator 30 is shown in FIGS. 1 and 2 as being proud of the housing of the lampholder 20, it may alternatively be flush therewith. Light from the LED 35 may be applied to or through the housing of the lampholder 20 in any suitable way—for example, by making at least part of the housing of the lampholder 20 translucent and/or by the use of optical fibres to conduct light from the LED 35 to any point on the lampholder 20.

Components on the circuit board 32 (described in more detail below) receive electric power from the terminals 21 and 22 and derive therefrom a suitable supply voltage for the LED 35 to cause it to illuminate. Thus, whenever electric power is present at the terminals 21 and 22, and therefore also at the lamp contacts 24 and 25 that are electrically connected to those terminals, the LED 35 is illuminated. Thus, the indicator 30 gives a continuous visual indication of the presence of electric power at the lamp contacts 24 and 25. In particular, this indication persists even when the lamp 10 fails or is not present. In this way, a user has an immediate, safe and reliable indication that the lampholder is live, and the user can then ensure that the power is switched off—for example, by a local switch, before attempting to change a failed lamp 10.

Since the life span of an LED is typically much greater than, for example, 60,000 hours and the life span of a tungsten lamp 10 is typically of the order of, for example, 1,000 hours, the LED 35 is likely to greatly outlast the life of many lamps 11.

The LED 35 may be replaced by other suitable indicating means. For example, there may be used a neon indicator that is connected directly to the terminals 21 and 22 in series with a suitable resistor. Alternatively, there may be provided an audible indicating device (e.g. of low and/or intermittent output), or a vibrating device that vibrates gently when power is present at the terminals 21 and 22.

Figure 3:
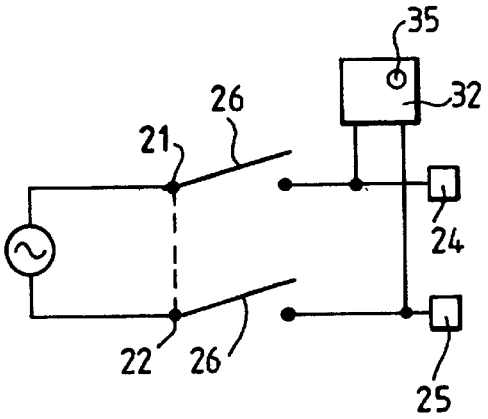
FIG. 3 is a circuit diagram of a modified version of the lampholder of FIGS. 1 and 2.

In the variant illustrated diagrammatically in FIG. 3, the mains power is switched at the lampholder 20 by means of a switch 26, which makes and breaks the electrical connections between the terminals 21, 22 and lamp contacts 24, 25 respectively. The circuit board 32 is connected to the output side of the switch 26, so that the LED 35 is illuminated when power is applied to the lamp contacts 24 and 25.

Figure 4:
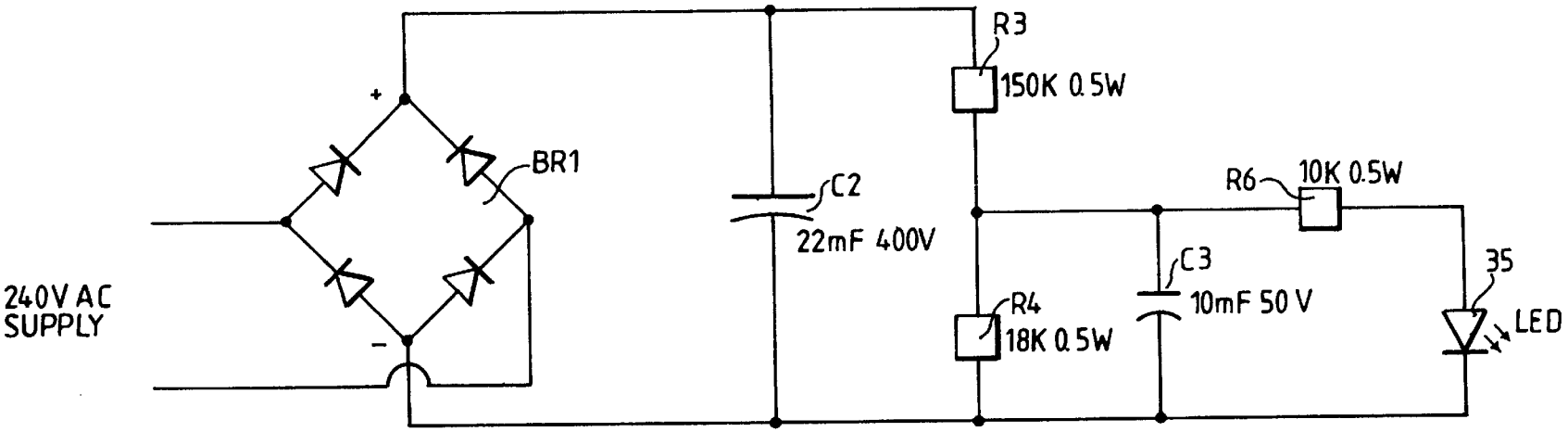
FIG. 4 is a circuit diagram of one example of a circuit board of the lampholder of FIGS. 1 and 2.

FIG. 4 shows one example of a circuit that may be provided on the circuit board 32, to illuminate the LED 35. The circuit comprises a full wave rectifier bridge BR1 smoothed by a capacitor C2. A potential divider R3, R4 provides a lowered voltage smoothed by capacitor C3 to power LED 35 through series-connected resistor R6.

Figure 5:
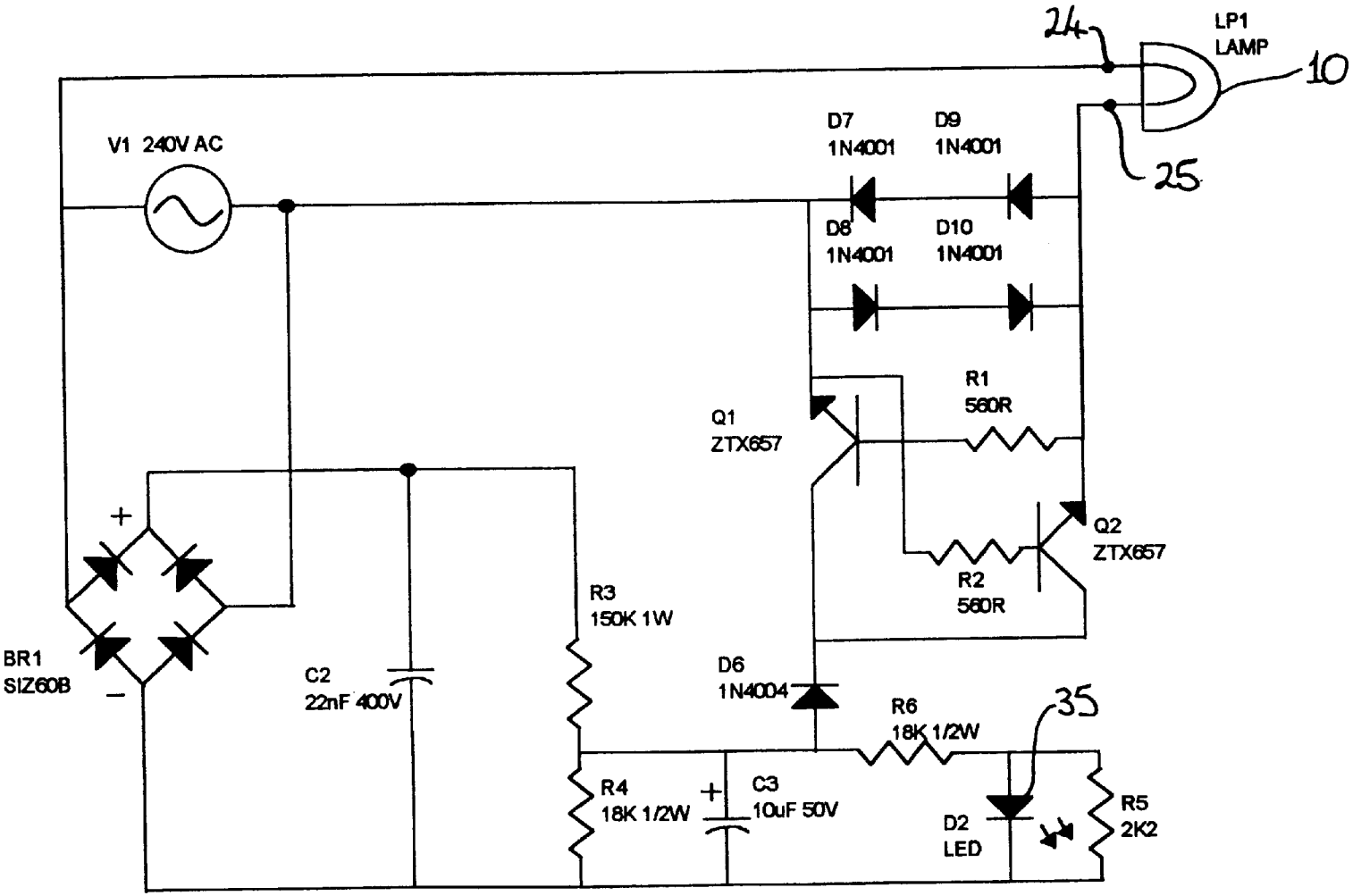
FIG. 5 is a circuit diagram of another example of a circuit board of the lampholder of FIGS. 1 and 2.

In the modified circuit of FIG. 5, components as shown in FIG. 4 are arranged in a generally similar manner, to provide a lowered voltage rectified from an AC supply V1, in order to power the LED 35. In this case, however, a further resistor R5 is placed in parallel with the LED 35. Also, the output node of the potential divider R3, R4 is connected via a diode D6 to the collector of transistors Q1 and Q2. The emitter of transistor Q1 is connected to one side of a diode network D7, D8, D9 and D10, while the emitter of transistor Q2 is connected to the other side. The base of transistor Q1 is connected to contact 25 via a resistor R1 and the base of transistor Q2 is connected to one side of the AC voltage supply V1 via a resistor R2. The contact 25 is connected to one side of the AC voltage V1 supply by the network of diodes D7, D9, D8 and D10, and the lamp contact 24 is connected to the other side of the voltage supply V1.

In use, so long as the lamp 10 is in circuit between the lamp contacts 24 and 25, current can flow for one half of the AC cycle through the diode array D7/D9, causing transistor Q1 to switch on, and through D8/D10 causing transistor Q2 to switch on for the other half of the AC cycle. With either transistor Q1 or Q2 switched on, the output node of potential divider R3, R4 is pulled down sufficiently to prevent the LED 35 from being illuminated. However, when the lamp 10 fails or is not present at the lamp contacts 24, 25, the transistors Q1 and Q2 can not draw base current and remain switched off. Therefore, the output node of the potential divider R3, R4 can output a potential sufficient to illuminate the LED 35.

In this way, the LED 35 is illuminated only when the lamp fails 11 or is not present at the lamp contact 24, 25. Since the useful life of the LED may already be typically two orders of magnitude higher than that of the tungsten lamp 10, the effective life the LED 35 in this particular circuit will exceed that of the tungsten lamp 10 by many orders of magnitude, since it is only switched on when the lamp 10 fails or is not present. This gives a much increased element of safety, as against the possibility of the LED 35 itself failing. Indeed, in practice, this arrangement is likely to provide the LED 35 with a probable working life very much greater than the lampholder, the wiring, or even the building itself. Thus the chance of a "false negative" indication virtually disappears.

In fact, the improved circuit of FIG. 5 may be used in an electrical connector other than a lampholder, and/or with other indicating means. For example, in the schematic diagram of FIG. 3, the contacts 24, 25 may represent the supply contacts of any electrical load, when a circuit operating along the lines of that of FIG. 5 is incorporated on the circuit board 32. That is, in such a circuit, the LED 35 (and/or other indicator) is activated only when the load supplied by the contacts 24, 25 fails or is not present.

Figure 6:
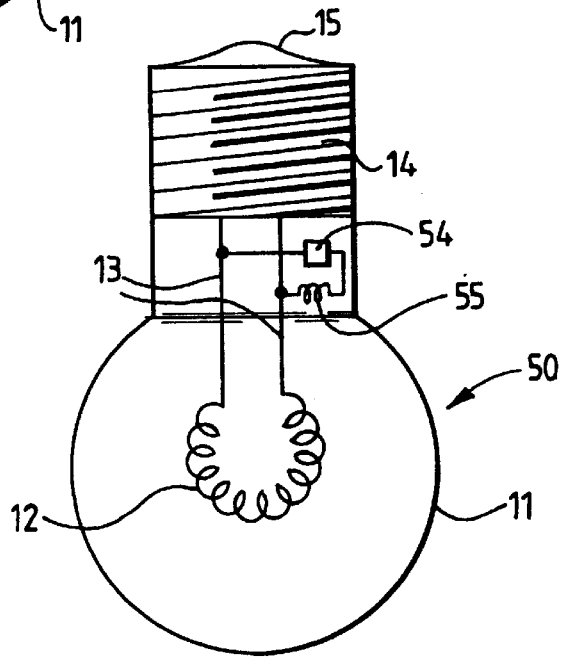
FIG. 6 shows an example of a lamp in accordance with another embodiment of the invention, in side view.

In the modified lamp 50 of FIG. 6, there is provided a tungsten filament 12 within an evacuated glass bulb 11 and connected to electrical conductors 13, generally as before. However, connected between the two electrical conductors 13 are a series-connected neon 55 and resistor 54. In use, the tungsten filament 12 provides a primary light-emitting device, and the neon 55 provides a secondary light-emitting device. The light intensity emitted by the filament 12 is very much greater than that emitted by the neon 55. Therefore, in normal use, the neon 55 will hardly be seen. However, in the event that the filament 12 fails, and this is the reason for the failure of the vase majority of lamps, the neon 55 continues to emit light. With the main filament 12 extinguished, the light emitted by the neon 55 becomes quite visible, and serves to indicate the presence of electric power at the lamp contacts 14, 15. Therefore, as before, a user can switch off the power supply to the lamp 10 at the local switch, the neon 55 indicating when this has safely been done.

Neons such as 55 and resistors such as 54 can be produced very cheaply by modern manufacturing techniques, and therefore can readily be incorporated into a lamp such as 11 at relatively modes cost. Since the typical service life of a neon greatly exceeds that of a normal tungsten lamp, there is a high degree of reliability in the indication provided by the neon 55.

For illustrative purposes, the neon 55 is shown adjacent the cap of the lamp 50, and it might be quite convenient to provide the neon 55 in such a location during manufacture of the lamp. However, it may alternatively be provided in any other convenient position. Although the neon 55 has been shown as an indicator in a tungsten filament lamp 50, it may alternatively be embodied in other types of lamps such as, for example, fluorescent tubes or compact fluorescent lamps.

As an alternative to the neon 55, the secondary light-emitting device may comprise an LED, a tungsten filament with higher tungsten content, or any other suitable device.

By way of example, the illustrated lamps may be designed to operate at a voltage in the range 100–120 volts or 200–250 volts, for example. One would very likely design a special neon for the job. Normally, a neon will be purpose designed for each specific application.

Although the embodiment of FIGS. 1 and 2 is illustrated as a suspended lampholder, it will be appreciated that other embodiments of the invention may be provided in other kinds of lampholders, such as a batten holder, a light fitting for a wall, table light or other light, or an adaptor that fits into an existing lampholder and provides lamp contacts in a further lampholder that corresponds to the existing lampholder. Alternative embodiments of the invention may also be provided in ceiling roses from which lampholders are suspended.

In this specification, the verb "comprise" has its normal dictionary meaning, to denote non-exclusive inclusion. That is, use of the word "comprise" (or any of its derivatives) to include one feature or more, does not exclude the possibility of also including further features.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly states otherwise. Thus, unless expressly stated otherwise, each feature disclosed is one example only of a generic series of equivalent or similar features.

The invention is not restricted to the details of the foregoing embodiment(s). The invention extends to any novel on, or any novel combination, of the features disclosed in this specification (including any accompanying claims, abstract and drawings), or to any novel one, or any novel combination, of the steps of any method or process so disclosed.

We claim:

1. A lampholder having lamp contacts for supplying electric power to a lamp in use, and an indicating means which is arranged to indicate continuously the presence of electric power at said lamp contacts when no lamp is present.

2. A lampholder according to claim 1, wherein said indicating means is arranged to provide a visible indication.

3. A lampholder according to claim 2, wherein said indicating means includes a neon or light-emitting diode to give said visible indication.

4. A lampholder according to claim 1, wherein said indicating means is arranged to provide an audible indication.

5. A lampholder according to claim 1, arranged as an adaptor to engage with an existing lampholder and to receive a lamp.

6. A lampholder according to claim 1, indicating a switch to connect and disconnect electric power to and from the lamp contacts.

7. A lamp having an evacuated enclosure and lamp contacts for supplying power to the lamp in use, the lamp comprising a main light-emitting device and a secondary signalling device, wherein said main light-emitting device is adapted to provide the principal light output of the lamp and said secondary signalling device is adapted to serve as indicating means to indicate the presence of power at said contacts, said main and secondary devices being contained within said evacuated enclosure of the lamp.

8. A lamp according to claim 7, wherein said main light-emitting device comprises a filament.

9. A lamp according to claim 7, wherein said secondary signalling device is a light-emitting device.

* * * * *